252-99 AU ~~166~~ 115 EX

10/3/78 XR 4,118,333

United States Patent [19]

Dugan et al.

[11] 4,118,333

[45] Oct. 3, 1978

[54] MANUFACTURE OF PARTICULATE DETERGENTS

[75] Inventors: Bernard Baron Dugan, Bryanston; Jacobus Cornelius Welgemoed, Edenvale, both of South Africa

[73] Assignee: Colgate-Palmolive Company, New York, N.Y.

[21] Appl. No.: 733,561

[22] Filed: Oct. 18, 1976

[30] Foreign Application Priority Data

Oct. 20, 1975 [ZA] South Africa ..... 75/6587
Jan. 21, 1976 [ZA] South Africa ..... 76/0345

[51] Int. Cl.[2] ..... C11D 11/00; C11D 7/16; C11D 3/04

[52] U.S. Cl. ..... 252/135; 252/89 R; 252/99; 252/174; 252/539; 23/293 A; 427/45

[58] Field of Search ..... 252/135, 539, 174, 99, 252/89; 34/1; 427/45; 23/293 A

[56] References Cited

U.S. PATENT DOCUMENTS

| | | | |
|---|---|---|---|
| 3,177,147 | 4/1965 | Dugan | 252/135 X |
| 3,366,570 | 1/1968 | Slob | 252/135 X |
| 3,649,545 | 3/1972 | Susuki et al. | 252/135 UX |
| 3,932,140 | 1/1976 | Jayawant | 252/99 X |

*Primary Examiner*—Mayer Weinblatt
*Attorney, Agent, or Firm*—Richard N. Miller; Murray M. Grill; Herbert S. Sylvester

[57] ABSTRACT

A dry, brittle detergent product of cellular particulate structure is produced with a bulk density between 0.25 and 0.40 gms/cc by forming the components of the detergent composition into an aqueous slurry mass and subjecting such mass to microwave irradiation for a sufficient period to cause boiling of labile water, intumescense of the mass and the formation of the product in question. Boiling of the labile water under the action of microwaves effects evaporation of such labile water but does not affect water of crystallization.

11 Claims, 1 Drawing Figure

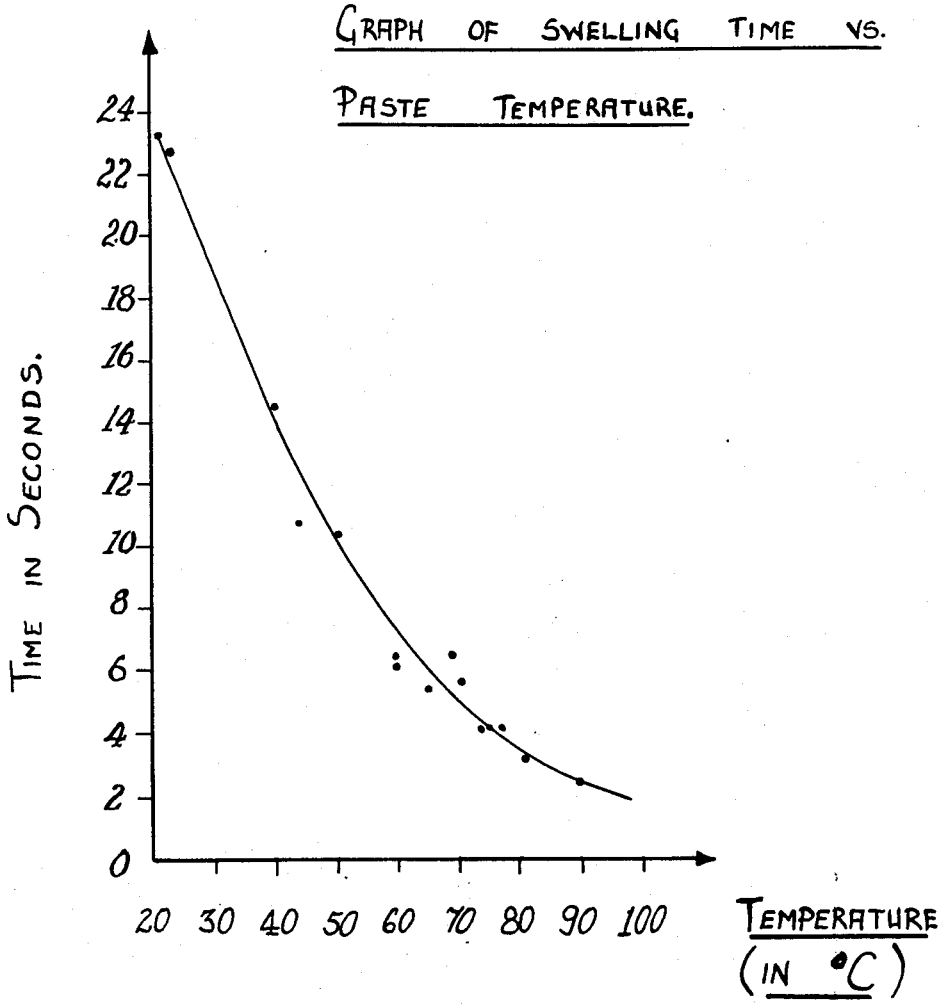
GRAPH OF SWELLING TIME VS.
PASTE TEMPERATURE.
TIME IN SECONDS.
24
22
20
18
16
14
12
10
8
6
4
2
0
20 30 40 50 60 70 80 90 100
TEMPERATURE
(IN °C)

MANUFACTURE OF PARTICULATE DETERGENTS

This invention relates to the production of detergent compositions in particulate form.

Detergent granules for domestic use are generally made by preparing a slurry of a surface active matter, usually the sodium salt of a sulphonated linear alkyl benzene, builders such as sodium silicate and sodium tripolyphosphate, a dirt suspending agent, usually carboxymethyl cellulose, an optical brightener and with other ingredients such as sodium sulphate and sodium chloride. These materials are all dispersed in water and partly dissolved to form the aqueous mass or slurry. This slurry is then spray-dried in drying towers in such a way that finely divided droplets of the slurry are mixed with hot air, the water boils away blowing the particles out in a spongelike mass and producing dry granules which have a loosely packed bulk density normally between 0.25 and 0.40 g/cc. The term "slurry" as used in this specification is intended to cover any material which can be poured or pumped or which is extrudable as a paste.

Alternative methods have been proposed for achieving the same results without the elaborate drying tower; for example, a mobile slurry has been prepared at such a concentration that it sets to a paste on cooling and is then expanded by the heating and resultant decomposition of hydrogen peroxide, the expanded mass so obtained setting to a brittle mass which is ground and sieved to give light-weight particles.

It was proposed in South African Pat. No. 72/6290 that an inhibitor be added to the slurry to slow down the rate of the exothermic hydration reaction of tripolyphosphate so that the expansion of the detergent mass could be effected at a convenient stage in the process. Ethyl alcohol in the form of industrial methylated spirits was proposed for this purpose. A concentration of 3% of methylated spirits on the whole mass was found to be effective in most cases. It was also proposed to react, in a slurry, sodium trimetaphosphate and caustic soda to form tripolyphosphate in situ and, in this case, the violent heat of reaction produced a mass of steam which blew the detergent mass out and produced, on setting, a lightweight spongy material which could be sieved.

Although these alternative processes involve the use of plant which is much cheaper than the standard spray-drying apparatus, they are, at the same time, all interrupted processes in the sense that the material has to set after expansion. It will be appreciated that a spongy material tends to inhibit the escape of heat so that setting can be a long process in the mass, often in excess of 24 hours.

It is an object of the invention to provide a process for the drying of a detergent composition which will provide a cellular product of required specific gravity and which can be adapted to continuous or semi-continuous production without the use of expensive spray-drying equipment.

According to the invention a method for removing a volatile component from a detergent composition which comprises heating an initial detergent composition containing a volatile component by means of microwave radiant energy for a period sufficient to vaporize at least a portion of said volatile component, removing said vaporized component, and recovering a resultant detergent composition having a reduced content of said volatile component.

The method may be adapted for use on an initial feed which is a partially dried solid or on a slurry, particularly an aqueous slurry of detergent components.

In one form when the feed is an aqueous slurry the product may spontaneously disintegrate to a granular mass while in another it will form a meringue-like form retaining block which may easily be broken up by being passed through a coarse sieve.

The volatile component evaporated by the method of the invention may be a polar solvent and/or water.

It is believed that intumescence and fragmentation caused by the method of the invention is due to the fact that microwave heating occurs uniformly throughout the mass so that the labile water boils to form steam which acts as an expanding agent simultaneously with the setting of the mass. Thus with progressive setting and expansion a cellular mass is formed. In some instances the simultaneous setting and expansion is so rapid that fragmentation occurs spontaneously giving granules and powder which on cooling provide an excellent particulate detergent of the required bulk density. In other cases a form retaining block is formed which is easy to break up.

The invention includes within its scope the formation of an expanded cellular mass which incorporates all the necessary components of a detergent composition. For example, the slurry treated may incorporate builders, adjuvants and all other required components including an anionic surface active agent such as a sulphonated linear alkyl benzene compound and/or a non-ionic surface active agent such as ethoxylated nonylphenol. Alternatively the expanded cellular mass may be formed excluding a vital component, such as the above non-ionic surface active agent, which can subsequently be sprayed and absorbed onto the brittle cellular product.

Preferably the method of the invention is adapted for use on a continuous basis wherein the initial detergent composition is introduced continuously into a microwave heating zone and the resultant detergent composition is continuously removed from said zone in solid form.

It will be appreciated that the required duration of exposure of the mass to microwave irradiation depends, inter alia, upon the nature of the microwave source, the bulk and form of the detergent mass and its proportion of solvent and/or water. It has been found, however, that microwaves having a length of 1 to 100 centimeters can be used to obtain the required drying and intumescing effects within a reasonable period. For example 1.3 Kw microwave generator producing waves of 2450 $MH_z$ is capable of suitably treating 50 grams of a detergent slurry containing about 40% of water in 30 to 60 seconds.

Further according to the invention the initial detergent composition in the form of an aqueous slurry mass is heated by conventional means prior to being subjected to microwave irradiation. For example, the aqueous slurry mass is heated to a temperature between 20° and 100° C. prior to being subjected to microwave irradiation. It has been found that if the aqueous mass of detergent components is pre-heated as set out above, intumescence under the influence of microwave flux takes place more rapidly, the decrease in period required for sufficient intumescence to take place so that the mass sets as a brittle cellular product being proportional to the increase in temperature to which the aqueous mass is preheated.

Thus by reference to the FIGURE it will be seen that a 50 gm aqueous mass having the composition set out in Example 1 took approximately 30 seconds to form an expanded brittle cellular product when it was introduced into a microwave generator at a temperature of 20° C. The generator used produced microwave flux of 650 watts at 2450 $MH_z$. This period decreased steadily with increase in temperature of the aqueous mass introduced into the generator so that when the aqueous mass was pre-heated to a temperature of 95° C. the required period for the formation of the brittle product was less than 2 seconds.

Thus by pre-heating the aqueous mass the comparatively expensive exposure to microwave irradiation is decreased and production cost of the product is likewise reduced.

Also according to the invention a current of air at a temperature higher than that of the ambient temperature is introduced into the microwave generator to sweep over the slurry mass during heating of the latter by microwave irradiation. For example the air introduced into the microwave generator may be at a temperature between 150° and 300° C. The stream of hot air increases the rate of evaporation of labile water thus further economizing on the relatively expensive microwave energy utilisation. In the preferred method of the invention the aqueous mass of selected detergent components is passed in a continuous stream through a microwave generator chamber and, while in the chamber both before and after intumescence occurs, the mass is swept with the current of hot air introduced either concurrent or counter current with the feed of the aqueous mass. The hot air extracted from the microwave generator may be used as a source of energy to pre-heat the feed.

Also in the preferred method according to the invention the aqueous mass incorporates an hydratable material, such as sodium tripolyphosphate, and a volatile inhibitor for the hydration reaction, which causes setting of the detergent mass, is incorporated into the slurry so that the expansion and fragmentation during irradiation is not damped by an undue proportion of the reaction occurring prematurely.

The inhibitor is driven off initially, when the mass is heated, and the required violent expansion and resulting fragmentation occurs under the influence of microwave irradiation. The inhibitor will normally be a suitable alcohol. Thus industrial methylated spirits may be added to the slurry in a proportion of about 1% or more. As is known, this materially retards the hydration of tripolyphosphate as well as the reaction between sodium trimetaphosphate and sodium hydroxide. When the alcohol is evaporated on heating, expansion, setting and fragmentation occur in a short period due to microwave heating. An alternative inhibitor is the non-ionic ethoxylated nonylphenol itself.

In order to assist the action of boiling water to effect intumescence under the action of microwave heating, a blowing agent may be incorporated into the aqueous mass of detergent components. Preferably the blowing agent used is hydrogen peroxide.

Still further according to the invention the slurry is formed to contain in excess of 30% of water. Preferably the slurry is formed to contain between 30 and 60% of water. It has been found that the quantity of water present in the aqueous mass of detergent components has a material effect on the nature of the end product.

A paste was prepared with the following formulation, the materials being present in parts by weight:

| | |
|---|---|
| Sodium Silicate 108° Tw.* | 200 |
| Water | 300 |
| NaOH (sodium hydroxide) | 20 |
| in water | 20 |
| Adjuvants (carboxymethylcellulose, melamine and optical brightener) | 10 |
| DDBSA (Dodecylbenzene Sulfonic Acid) | 200 |
| STS (Sodium Toluenesulfonate) | 20 |
| STPP (Sodium Tripolyphosphate) | 500 |
| $Na_2SO_4$ (sodium sulfate) | 510 |
| | 1780 |

*A sodium silicate having a specific gravity of 1.54, by weight.

The water content of the above paste was approximately 30%, yet the paste was too stiff for good expansion under microwaves. The resulting powder after microwave irradiation nevertheless had a bulk density of 0.35. A portion of the paste was mixed with more water to a slurry-like consistency and this was again expanded under microwaves. Expansion in this case was excellent and the resulting powder had a bulk density of 0.28.

Because the above paste had been too stiff, a further batch was mixed using a higher water-content. In this case the slurry was rather too thin but was nevertheless expanded under microwaves. Weight loss was measured and this was used to calculate the approximate composition of the resulting powder. The following was found:

| | Slurry (approx. % | Powder (approx. %) |
|---|---|---|
| Active matter | 10 | 22 |
| Silicate solids | 9 | 20 |
| STS | 1,5 | 3 |
| Adjuvants | 0,3 | ca.1 |
| STPP | 20 | 43 |
| Water (total) | 60 | 13 |

The bulk density of the powder was 0.25 g/cc.

The above experiments indicate:

1. That within limits the more water that is present in the paste the lighter the resulting powder after treatment in the microwave flux;
2. There is a high retention of water presumably as water of crystallisation, although the powder is dry and brittle. This is an important factor because it is presumably due to the fact that the microwave flux will only heat and boil off labile water and has no effect at all upon water which is bound in crystal form. It is this which distinguishes microwave heating from all other types of heating and enables a substantial amount of water to be incorporated in a dry powder thereby providing the cheapest possible inert ingredients;
3. When the last mentioned powder was analysed it was found that the phosphorous present was 9.6% as 'P' in the form of condensed phosphate and 0.2% as orthophosphate. This indicates that the microwave drying has had virtually no decomposing effect on the polyphosphate, and this high polyphosphate retention is a desirable factor not easily achieved by other methods of drying.

The following examples illustrate the invention:

EXAMPLE 1

| | |
|---|---|
| Linear alkyl benzene sulphonic acid | 320 parts by weight |
| Water | 27 parts by weight |
| Hydrogen peroxide | 3 parts by weight |
| Sodium hydroxide | 40 parts by weight |
| Water | 120 parts by weight |
| Low alkaline sodium silicate solution | 300 parts by weight |
| Carboxymethyl cellulose | 19 parts by weight |
| Optical brightener | 1 part by weight |
| Industrial methylated spirits | 60 parts by weight |
| Pentasodium tripolyphosphate | 1110 parts by weight |

The sulphonic acid was bleached by the addition of 27 parts of water containing 3 parts of 140 vol. hydrogen peroxide (38% by weight of hydrogen peroxide in water).

40 parts of caustic soda were dissolved in 120 parts of water and this was added to the 300 parts of sodium silicate solution. This was stirred with the carboxymethyl cellulose and the optical brightener for 30 minutes. The industrial methylated spirits and the bleached sulphonic acid were then neutralised into this mass and, finally, the tripolyphosphate stirred in.

The product was a stiff paste which could be handled as such for about 15 minutes. A layer of the material about 2 cms thick was placed for 60 seconds in a microwave oven producing 2450 Megaherz waves. The resulting product was an expanded but damp powder which did not set to a crisp granular state.

After several hours, the original mixture had set to a soft, crumbly solid. A portion (100 parts) of this was blended to a soft paste with 20 parts of water. A portion of the paste was placed in a thin layer in the microwave oven for 60 seconds. During this time the material expanded into a dry meringue-like cake. After cooling the material was passed through a 10 mesh screen and was an excellent granular product with a bulk density of 0.35.

The balance of this latter paste was retained and remained a workable paste for at least 24 hours.

EXAMPLE 2

| | |
|---|---|
| Linear alkyl benzene sulphonic acid | 320 parts by weight |
| Water | 27 parts by weight |
| Hydrogen peroxide | 3 parts by weight |
| Sodium hydroxide | 40 parts by weight |
| Water | 520 parts by weight |
| Low alkaline sodium silicate solution | 300 parts by weight |
| Carboxymethyl cellulose | 19 parts by weight |
| Optical brightener | 1 part by weight |
| Industrial methylated spirits | 40 parts by weight |
| Pentasodium tripolyphosphate | 1130 parts by weight |

The sulphonic acid was bleached by the addition of 27 parts of water containing 3 parts of 140 vol. hydrogen peroxide (38% by weight of hydrogen peroxide in water).

40 Parts of caustic soda were dissolved in 120 parts of water and this was added to the 300 parts of sodium silicate solution. This was stirred with the carboxymethyl cellulose and the optical brightener for 30 minutes.

The industrial methylated spirits and the bleached sulphonic acid were then neutralised into this mass and, finally, the tripolyphosphate stirred in.

The product was a stiff paste which could be handled as such for about 15 minutes. A layer of the material about 2 cm thick was placed for 60 seconds in a microwave oven producing 2450 Megaherz waves. The resulting product was an expanded dry meringue-like mass.

A portion (120 parts) of the stiff paste was blended to a soft paste with 20 parts of water. A portion of the paste was placed in a thin layer in the microwave oven for 60 seconds. During this time the material expanded into a dry meringue-like cake. After cooling the material was passed through a 10 mesh screen and was an excellent granular product with a bulk density of 0.30.

The balance of the soft paste was retained and remained a workable paste for at least 24 hours.

The advantages of this aspect of the present invention are apparent. It would be unnecessary to process a batch of paste through microwave equipment before the expanding characteristics diminished. The paste could deliberately be allowed to become crumbly and stored indefinitely in this intermediate form. When required for processing, large batches of the intermediate could be blended with a further quantity of water. The resulting paste could be expanded in suitable continuous microwave equipment without danger of setting or loss of expanding characteristics.

It will be apparent that this process may be operated semi-continuously. The paste could be prepared and extruded on to a continuous polypropylene belt passing through a microwave chamber, arrangements being made for the correct residence time, and a stream of cold air could be swept over it and through the chamber, carrying away all the released fumes and rapidly cooling the emergent granules which could be discharged from the belt ready for packing, or brushing through a sieve, if necessary.

EXAMPLE 3

The stable, soft paste of Example 2 was fed by a suitable pump through a nozzle on to a moving endless belt of PTFE bonded fibre glass. The feed-rate was adjusted so that a layer of paste about 1 cm. thick was continuously deposited onto the belt, which had a variable speed drive.

The belt was arranged to pass through a microwave applicator tunnel connected to a microwave generator of variable power output operating at 900 $MH_z$. The tunnel through which the belt passed could also accommodate a stream of hot air countercurrent to the direction of passage of the belt. The first experiment was conducted by feeding paste at 20° C. onto the belt just before the point at which the belt entered the microwave applicator tunnel. Under these conditions, the belt speed was adjusted so that the expanded meringue-like cake emerged just dry at the tunnel exit and the retention time of the paste in the applicator was 40 seconds. No countercurrent air stream was used.

In the second experiment the paste in the feed tank was heated by means of steam coils so that the paste being fed to the belt was at 80° C. A hot countercurrent air stream was passed through the tunnel, the air stream temperature at the point of emergence of the belt being set at 150° C. Under these conditions the retention time of the paste in the tunnel for complete dryness was reduced to 5 seconds.

A further application of this invention is to take sodium silicate, tripolyphosphate, carboxymethyl cellulose and optical brightener, if required, and to expand them in the same way. This gives a very dry, brittle mass which may be broken down into granules and a suitable quantity of non-ionic detergent, such as a nonyl phenol condensed between 9 and 10 molecules of ethylene oxide, sprayed and absorbed on to the mass.

It is to be understood that the invention is not limited to the treatment of aqueous slurries.

The microwave drying technique is useful to remove additional moisture from detergent particles which have already been partially dried by spray drying, spray cooling, and other dehydration techniques.

We claim:

1. A method of making a detergent composition in particulate, cellular form comprising the steps of forming an aqueous slurry of detergent components selected from the group consisting of water-soluble anionic or nonionic detergent salt, detergent builder salts, detergent adjuvants, and mixtures thereof, said slurry containing between 30 to 60% by weight of water and having a temperature of 20° C. to 100° C.; heating a layer of said aqueous slurry by means of microwave radiant energy in a microwave heating zone for a period sufficient to vaporize an amount of the water sufficient to effect intumescence and setting of said slurry into the form of a cellular mass; and fragmenting said cellular mass to form a particulate detergent composition having the bulk density of a spray dried detergent composition.

2. A method in accordance with claim 1 wheren said fragmenting step takes place during the microwave heating step.

3. A method in accordance with claim 1 wherein the initial detergent composition is introduced continuously into a microwave heating zone and the resultant detergent compostion is continuously removed from said zone in solid form.

4. A method in accordance with claim 1 wherein the microwaves have a wave length of from 1 to 100 centimeters.

5. A method in accordance with claim 1 wherein said slurry is heated by microwave radiant energy to a temperature in the range of 60° to 140° C.

6. A detergent composition produced in accordance with the method of claim 1.

7. A method in accordance with claim 1 wherein air at a temperature of 150° C. to 300° C. is flowed over said slurry during the period it is subjected to the microwave radiant energy.

8. A method in accordance with claim 1 wherein said aqueous slurry further includes hydrogen peroxide in an amount effective to facilitate intumescence of said slurry during the microwave heating.

9. A method in accordance with claim 1 wherein the aqueous slurry includes an hydratable inorganic builder ingredient.

10. A method in accordance with claim 9 wherein said aqueous slurry further includes at least about 1% by weight of ethanol to inhibit hydration of said hydratable ingredient.

11. A method in accordance with claim 9 wherein said hydratable ingredient is sodium tripolyphosphate.

* * * * *